US009780472B2

(12) United States Patent
Ishimaru

(10) Patent No.: US 9,780,472 B2
(45) Date of Patent: Oct. 3, 2017

(54) ELECTRIC CONNECTOR

(71) Applicant: DAI-ICHI SEIKO CO., LTD., Kyoto-shi (JP)

(72) Inventor: Masao Ishimaru, Fukuoka (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 0 days.

(21) Appl. No.: 15/411,304

(22) Filed: Jan. 20, 2017

(65) Prior Publication Data

US 2017/0250482 A1 Aug. 31, 2017

(30) Foreign Application Priority Data

Feb. 26, 2016 (JP) ..... 2016-036118

(51) Int. Cl.
*H01R 12/00* (2006.01)
*H01R 12/73* (2011.01)
*H01R 12/70* (2011.01)

(52) U.S. Cl.
CPC ..... *H01R 12/737* (2013.01); *H01R 12/7005* (2013.01)

(58) Field of Classification Search
CPC ..... H01R 12/737
USPC ..... 439/62
See application file for complete search history.

(56) References Cited

U.S. PATENT DOCUMENTS 6,471,541 B2 10/2002 Kunishi et al.
6,851,968 B2 * 2/2005 Tsunematsu ..... H01R 12/79 439/495
7,101,220 B2 * 9/2006 Satou ..... H01R 12/89 439/492
7,214,081 B1 * 5/2007 Ju ..... H01R 12/79 439/260

(Continued)

FOREIGN PATENT DOCUMENTS

CN 101997197 A 3/2011
JP 2001-345136 12/2001
JP 3278742 4/2002

OTHER PUBLICATIONS

Extended European Search Report issued Jul. 27, 2017 in Patent Application No. 17157533.5.

*Primary Examiner* — Tulsidas C Patel
*Assistant Examiner* — Peter G Leigh
(74) *Attorney, Agent, or Firm* — Oblon, McClelland, Maier & Neustadt, L.L.P.

(57) ABSTRACT

Occurrence of unnecessary conduction or damage upon insertion of a plate-shaped signal transmission medium can be prevented by a simple configuration. The rigidity relation between a medium abutting portion and a coupling beam portion of a contact member is configured so that a contact point portion of the contact member is positioned in the interior of a contact housing portion in a stage before a plate-shaped signal transmission medium is sandwiched when the plate-shaped signal transmission medium is to be inserted to the interior of a medium insertion path along a (Continued)

medium guide surface of an insulating housing. By virtue of this, the contact point portion of the contact member is configured to be maintained in a state in which it is lowered below the medium guide surface upon insertion of the plate-shaped signal transmission medium so that the contact point portion of the contact member does not contact the plate-shaped signal transmission medium.

4 Claims, 16 Drawing Sheets

(56) References Cited

U.S. PATENT DOCUMENTS

| | | | | |
|---|---|---|---|---|
| 7,275,948 | B2 * | 10/2007 | Miura | H01R 12/88 439/260 |
| 7,275,954 | B2 * | 10/2007 | Ikenaga | H01R 12/592 439/494 |
| 7,300,304 | B1 * | 11/2007 | Takashita | H01R 12/88 439/260 |
| 7,344,399 | B2 * | 3/2008 | Iijima | H01R 12/79 439/260 |
| 7,534,130 | B2 * | 5/2009 | Tanaka | H01R 12/79 439/495 |
| 8,192,219 | B2 * | 6/2012 | Satoh | H01R 12/79 439/328 |
| 8,337,226 | B2 * | 12/2012 | Yokoo | H01R 12/79 439/260 |
| 8,864,512 | B2 * | 10/2014 | Inomae | H01R 12/774 439/260 |
| 2003/0087544 | A1 | 5/2003 | Nogawa et al. | |
| 2010/0184319 | A1 | 7/2010 | Kameda | |

* cited by examiner

ELECTRIC CONNECTOR

BACKGROUND OF THE INVENTION

Field of the Invention

The present invention relates to an electric connector configured to cause a contact point portion of a contact member to abut a plate-shaped signal transmission medium inserted to interior of a medium insertion path by elastically displacing the contact member by turning of an actuator cam.

Description of Related Art

Generally, in various electric devices, etc., as means for electrically connecting various plate-shaped signal transmission media such as flexible printed circuits (FPC), flexible flat cables (FFC), etc., various electric connectors are widely used. For example, in an electric connector used by being mounted on a printed wiring board like below-described Patent Document, etc., a plate-shaped signal transmission medium composed of, for example, above described FPC or FFC is inserted to interior of a medium insertion path through an opening of an insulating housing (insulator), and an actuator (connection operating means), which is at a "standby position (opened position)" at that point of time and is maintaining the plate-shaped signal transmission medium in an opened state, is configured to be turned by the operating force of an operator so as to be pushed down toward a "working position (closed position)" in a front side or a rear side of the electric connector.

Then, when the actuator (connection operating means) undergoes the turning operation to the "working position (closed position)" at which the plate-shaped signal transmission medium is sandwiched, a medium pressing portion (pressurizing portion) provided on the actuator is brought into pressure-contact with a surface of the plate-shaped signal transmission medium (for example, FPC, FFC), and the plate-shaped signal transmission medium is sandwiched between the medium pressing portion and the contact member by the pressing force of the medium pressing portion (pressurizing portion) of the actuator, and the plate-shaped signal transmission medium is caused to be in a fixed state. On the other hand, when a turning operation is carried out in the direction in which the actuator at the "working position (closed position)" is raised to the upper side toward the original "standby position (opened position)", the pressing force of the medium pressing portion (pressurizing portion) of the actuator is cancelled, and, when it reaches the "standby position (opened position)", the plate-shaped signal transmission medium can be removed.

On the other hand, in the interior of the insulating housing (insulator), a plurality of electrically-conductive (for example, made of metal, etc.) contact members are arranged so as to form a multipolar shape. However, generally, these contact members are set so as to be already in a slight contact state with respect to the plate-shaped signal transmission medium from the point of time when the plate-shaped signal transmission medium (for example, FPC, FFC) is inserted to the interior of the medium insertion path, in other words, when the actuator (connection operating means) is at the "standby position (opened position)", and the plate-shaped signal transmission medium inserted to the interior is configured to be temporarily retained by the abutting force of the contact members, which are in such a slight contact state. Then, the actuator is turned to the "working position (closed position)" in the above described manner, and the medium pressing portion (pressurizing portion) is brought into a pressure-contact state with the plate-shaped signal transmission medium (for example, FPC, FFC); as a result, electrically-conductive paths (electrode pattern) provided on the plate-shaped signal transmission medium are brought into an abutting state with respect to the contact point portions of the contact members, thereby forming signal circuits or ground circuits.

However, if the temporarily retained state in which the contact members are abutting the plate-shaped signal transmission medium (for example, FPC, FFC) is obtained from the period in which the actuator (connection operating means) is at the "standby position (opened position)" in the above described manner, an electrically conducting state is obtained from a point immediately after the plate-shaped signal transmission medium is inserted. Therefore, for example, even if a conduction test is carried out erroneously in the state in which the actuator has not been subjected to the turning operation to the "working position (closed position)", a successful state is obtained, and it may be transferred to shipment in that state. Moreover, when the plate-shaped signal transmission medium is to be inserted into the medium insertion path of the insulating housing (insulator) in the state in which the actuator (connection operating means) is at the "standby position (released position)", an insertion distal-end part of the plate-shaped signal transmission medium may collide with the contact members, and peeling or exfoliation of the electrically-conductive paths (electrode pattern) may be caused.

The inventor of the present application discloses a conventional document of the present invention as following.

[Patent Document 1] Japanese Patent Application Laid-Open No. 2001-345136

SUMMARY OF THE INVENTION

Therefore, it is an object of the present invention to provide an electric connector capable of preventing occurrence of unnecessary conduction and damage of a plate-shaped signal transmission medium when the plate-shaped signal transmission medium is to be inserted.

In order to achieve the above described object, the present invention employs a configuration of an electric connector used in a state in which the electric connector is mounted on a wiring board, the electric connector having: an insulating housing having a medium insertion path to which a plate-shaped signal transmission medium is to be inserted; a medium guide surface serving as part of a surface of the insulating housing forming the medium insertion path and configured to guide the plate-shaped signal transmission medium inserted to interior of the medium insertion path; a contact housing portion provided in a recessed manner in a state in which the contact housing portion is dented in a groove shape from the medium guide surface; an electrically-conducive contact member having part disposed in interior of the contact housing portion; and an actuator cam turnably attached to the insulating housing and configured to be subjected to a turning operation about a turning shaft determined in advance so as to reciprocate between a standby position and a working position; the electric connector configured so that a contact point portion of the contact member abuts the plate-shaped signal transmission medium inserted in the medium insertion path along the medium guide surface when the contact member is elastically displaced by the actuator cam undergone the turning operation from the standby position to the working position, wherein the contact member is provided with a medium abutting portion having first and second main beams configured to be displaced by the actuator cam, a fixation base portion connected to the wiring board, and an elastically-displaceable coupling beam portion integrally connecting the medium abutting portion and the fixation base portion; a rigidity F1 of the coupling beam portion of a case in which the coupling beam portion is elastically displaced is set to be the same as or smaller than a rigidity F2 of the medium abutting portion of a case of displacement to a direction in which the medium abutting portion abuts the plate-shaped signal transmission medium ($F1 \leq F2$); while, when the actuator cam is at the standby position, the contact point portion of the first or second main beam constituting the contact member is positioned in the interior of the contact housing portion and maintained in a state in which the contact point portion is lowered below the medium guide surface from the medium insertion path; and the contact point portion of the first or second main beam in a case in which the actuator cam is subjected to the turning operation toward the working position is displaced from the interior of the contact housing portion toward the medium guide surface and abuts the plate-shaped signal transmission medium disposed in the medium insertion path.

According to the present invention having such a configuration, the rigidity relation between the medium abutting portion and the coupling beam portion of the contact member is configured to be set so that, in the stage in which the actuator cam is at the standby position before abutting with the plate-shaped signal transmission medium is carried out, the contact point portion of the contact member is positioned in the interior of the contact housing portion and is maintained in the state in which the contact point portion is lowered below the medium guide surface, and, therefore, the plate-shaped signal transmission medium inserted to the interior of the medium insertion path does not contact the contact point portion of the contact member, and occurrence of unnecessary conduction or damage of the plate-shaped signal transmission medium is prevented.

More over in the prevent invention, it is desired that the actuator cam be turnably supported by a turning-shaft bearing surface provided on the contact member; the contact point portion of the contact member be disposed to be opposed to the actuator cam; and the contact point portion of the contact member be disposed to be opposed to a part between an end surface of the actuator cam in the state turned to the working position and the turning-shaft bearing surface.

According to the present invention having such a configuration, the contact point portion of the contact member stably contacts the plate-shaped signal transmission medium.

Moreover, in the present invention, it is desired that the coupling beam portion of the contact member be disposed to be tilted with respect to an expending direction of the wiring board.

According to the present invention having such a configuration, the span length of the coupling beam portion is sufficiently ensured in small space, and the plate-shaped signal transmission medium is stably sandwiched.

Moreover, in the present invention, it is desired that the coupling beam portion of the contact member constitute part of the first or second main beam.

According to such a configuration, the stress generated in the coupling beam portion is dispersed toward the first or second main beam, and plastic deformation or damage of the contact member caused by stress concentration is prevented.

As described above, the electric connector according to the present invention configures the rigidity relation between the medium abutting portion and the coupling beam portion of the contact member so that, in the stage before abutting with the plate-shaped signal transmission medium is carried out when the plate-shaped signal transmission medium is to be inserted to the interior of the medium insertion path along the medium guide surface of the insulating housing, the contact point portion of the contact member is positioned in the interior of the contact housing portion. By virtue of this, upon insertion of the plate-shaped signal transmission medium, the contact point portion of the contact member is maintained in the state in which it is lowered below the medium guide surface so that the contact point portion of the contact member is configured not to contact the plate-shaped signal transmission medium. Therefore, occurrence of unnecessary conduction or damage of the plate-shaped signal transmission medium in the case in which the plate-shaped signal transmission medium is to be inserted can be prevented by the simple configuration.

DETAILED DESCRIPTION OF THE PREFERRED EMBODIMENTS

Hereinafter, embodiments in which the present invention is applied to an electric connector used by being mounted on a printed wiring board in order to connect a plate-shaped signal transmission medium including a flexible printed circuit (FPC), flexible flat cable (FFC), etc. will be described in detail based on drawings.

[About Overall Structure of Electric Connector]

Figure 2:
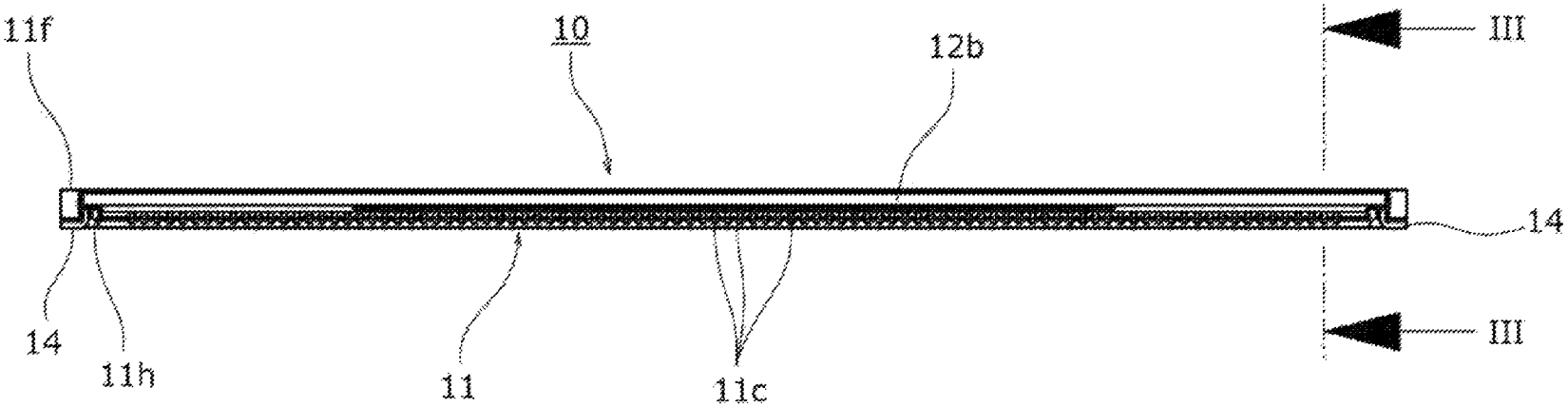
FIG. 2 is a front explanatory view of the electric connector in a closed state shown in FIG. 1.
Figure 3:
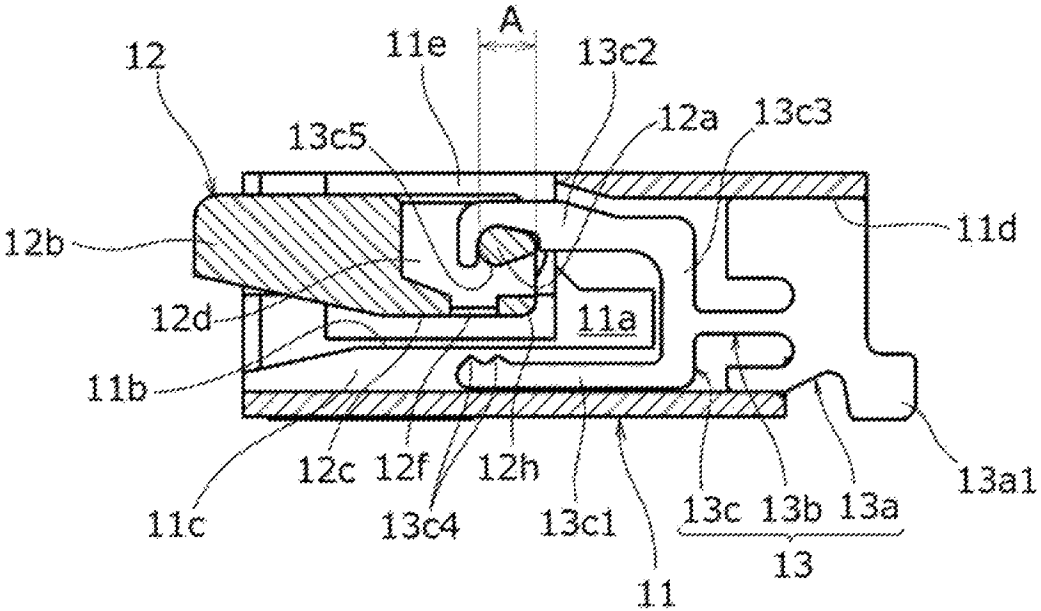
FIG. 3 is an explanatory view showing a transverse cross section along a line III-III in FIG. 2 in an enlarged manner.
Figure 5:
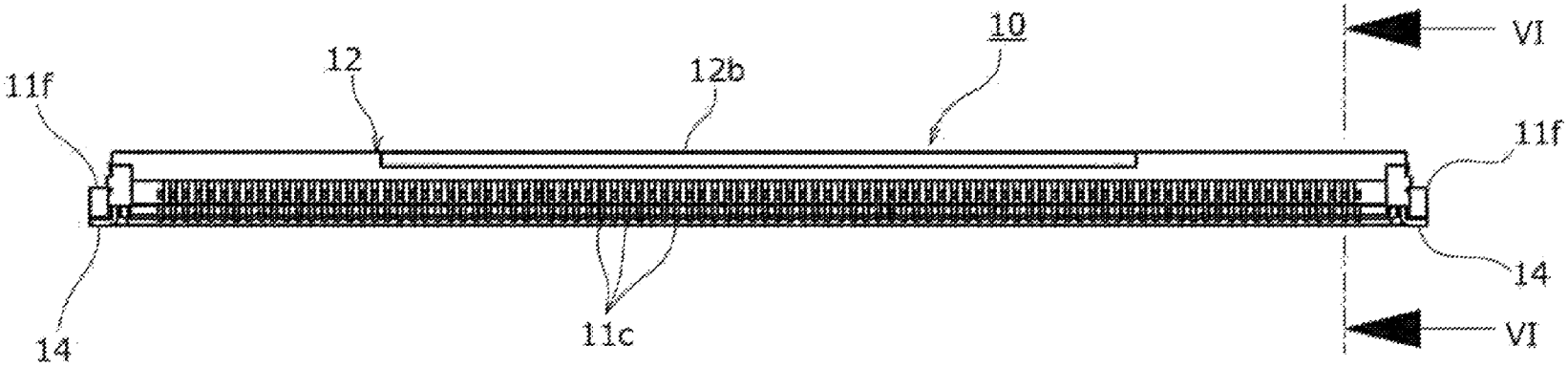
FIG. 5 is a front explanatory view of the electric connector at the standby position (opened position) shown in FIG. 4.
Figure 6:
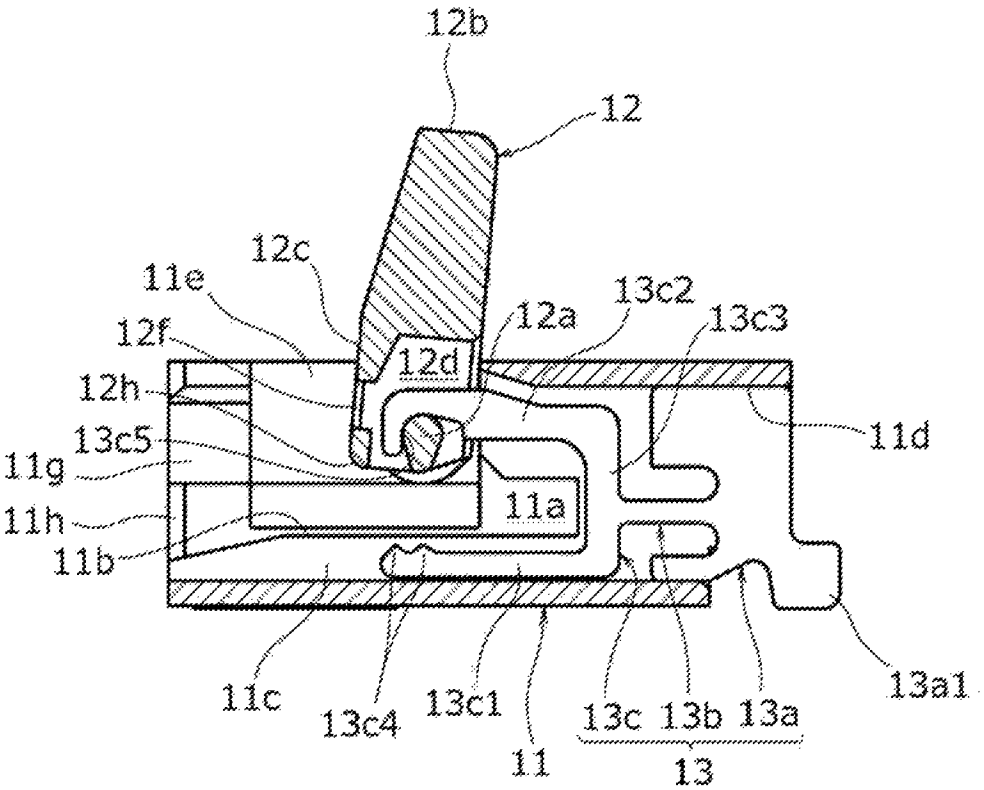
FIG. 6 is an explanatory view showing a transverse cross section along a line VI-VI in FIG. 5 in an enlarged manner.
Figure 7:
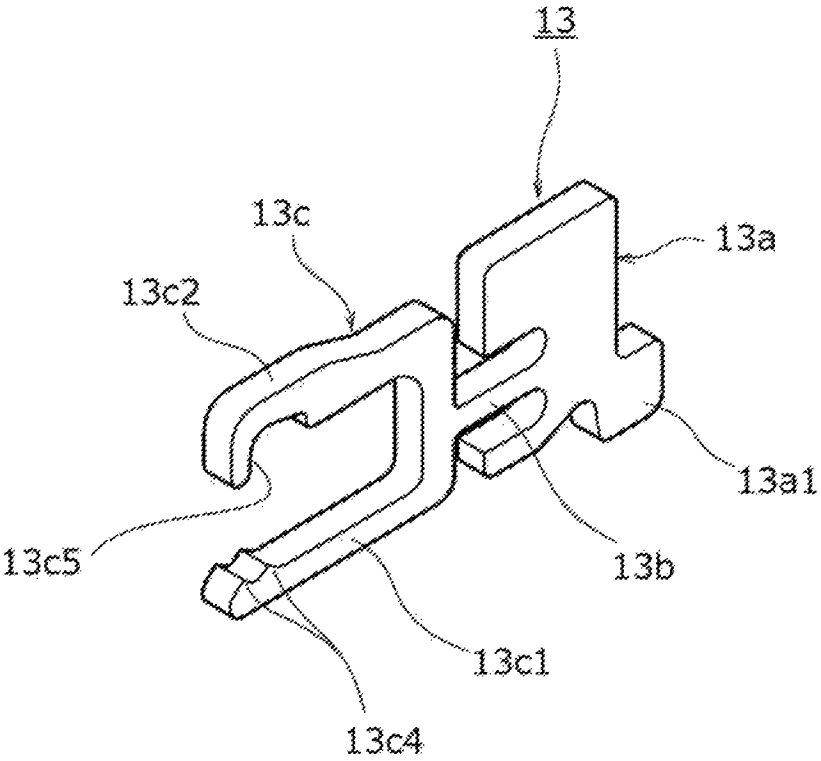
FIG. 7 is an external perspective explanatory view showing a single electrically-conductive contact member used in the electric connector shown in FIG. 1 to FIG. 6.
Figure 8:
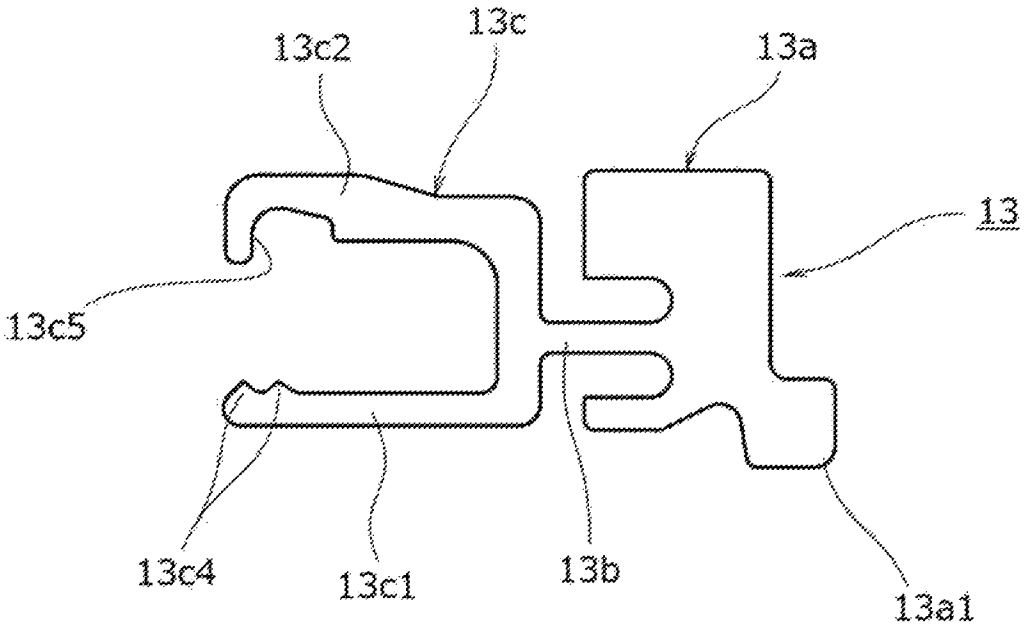
FIG. 8 is a lateral explanatory view showing the single electrically-conductive contact member shown in FIG. 7.
Figure 9:
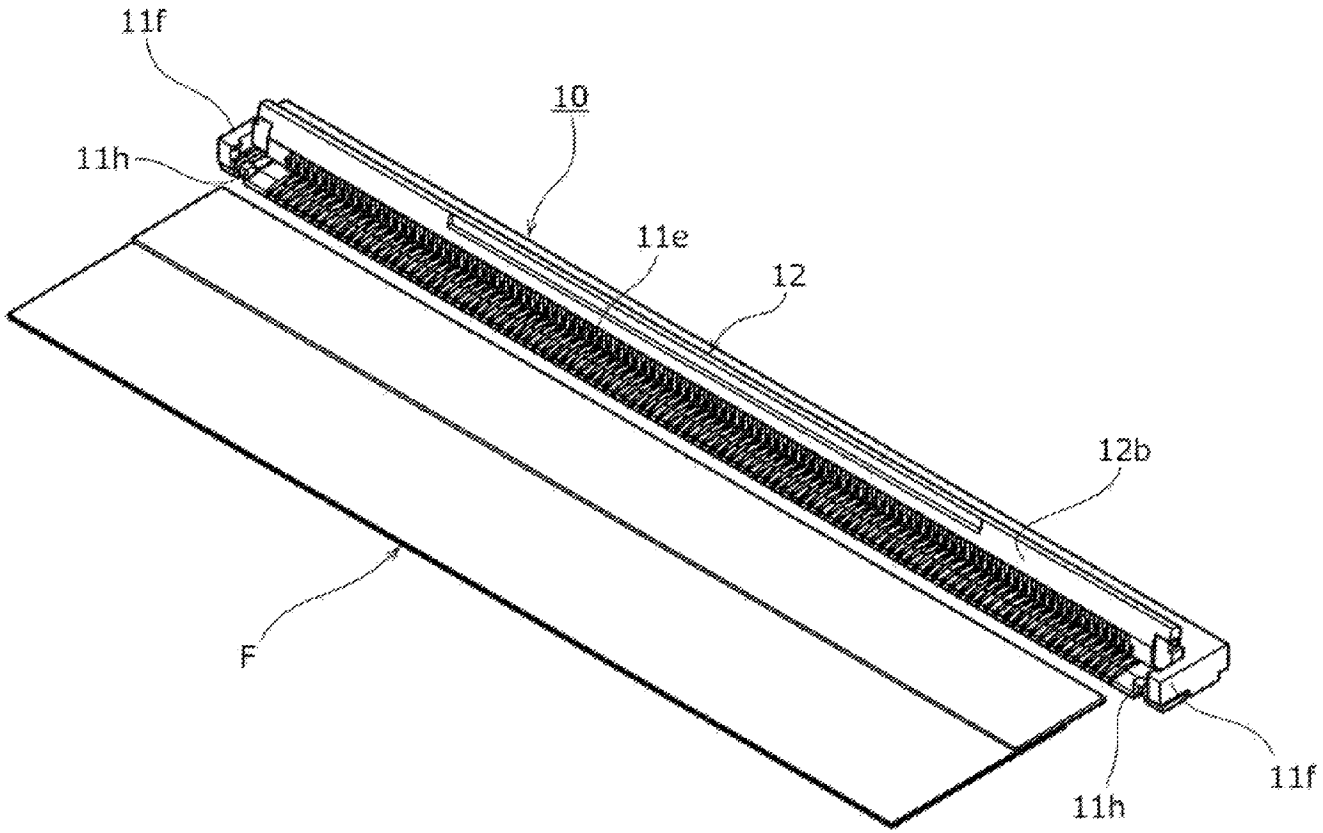
FIG. 9 is an external perspective explanatory view showing, from the front side, a state in which the plate-shaped signal transmission medium is disposed to be opposed to the electric connector according to the present embodiment in which the actuator is flipped up to the standby position (opened position)
Figure 10:
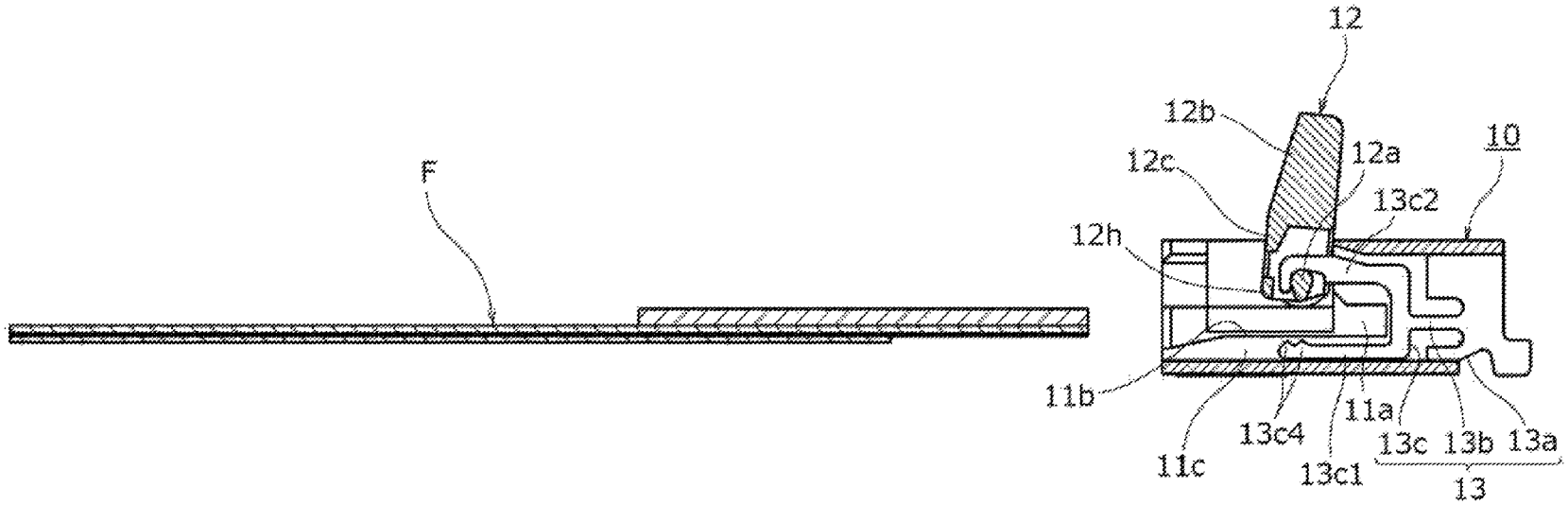
FIG. 10 is a transverse sectional explanatory view corresponding to FIG. 3 of the electric connector according to the present invention, which is in the state shown in FIG. 9.
Figure 11:
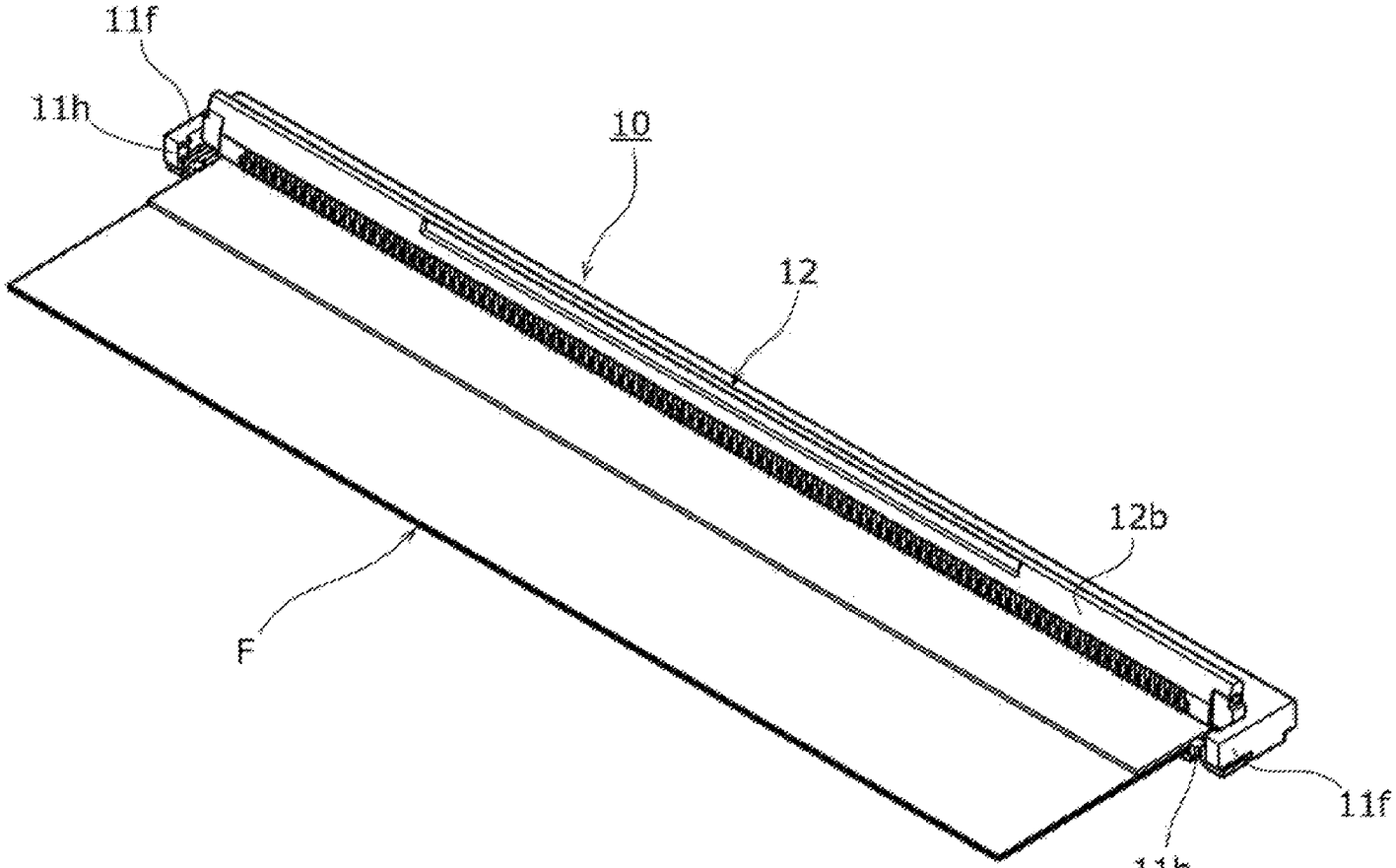
FIG. 11 is an external perspective explanatory view showing, from the front side, a state in which the plate-shaped signal transmission medium is inserted to the electric connector according to the present embodiment from the state shown in FIG. 9.
Figure 12:
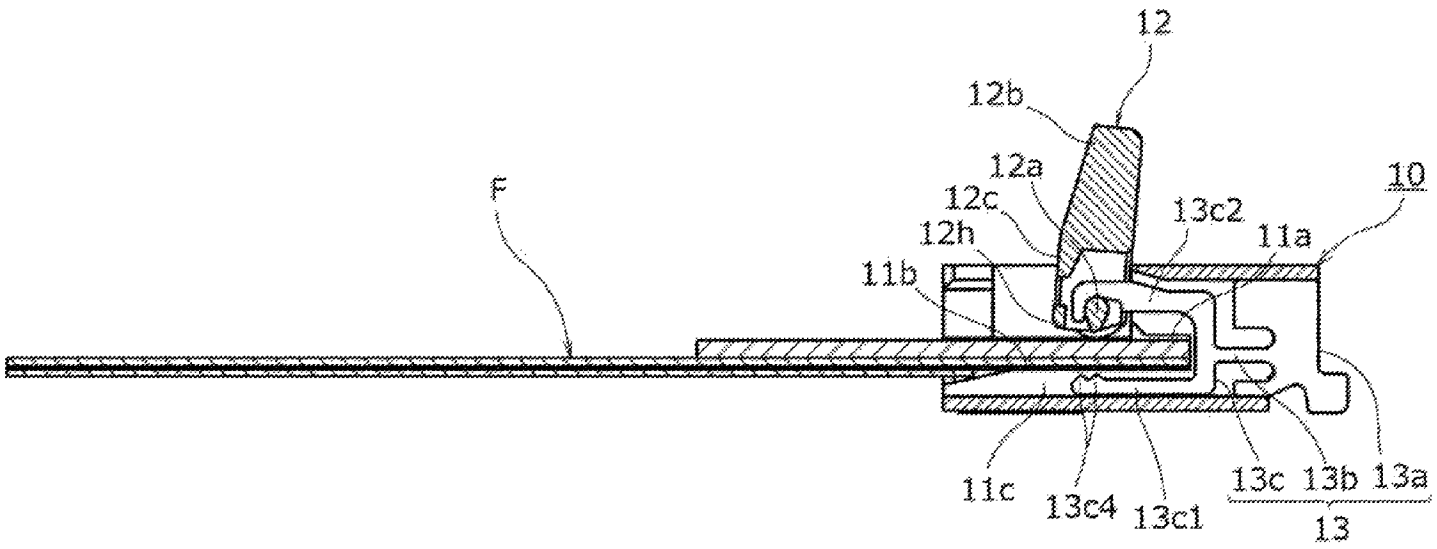
FIG. 12 is a transverse sectional explanatory view corresponding to FIG. 3 of the electric connector according to the present embodiment, which is in the state shown in FIG. 11.

Specifically, an electric connector 10 according to an embodiment of the present invention shown in FIG. 1 to FIG. 14 is an electric connector having a so-called front-flip-type structure in which an actuator 12 serving as a connection operating means is attached to part of an insulating housing 11 that is close to the front side (the part close to the left side in FIG. 3 and FIG. 6). The above described actuator (connection operating means) 12 is in a turned state so as to be pushed down toward the connector front-end side (left-end side in FIG. 3 and FIG. 6) to which a terminal part of a plate-shaped signal transmission medium (for example, FPC or FFC) F is to be inserted.

The insulating housing 11 is formed by an insulating member having a slenderly-extending hollow frame shape, the longitudinal direction of the insulating housing 11 will be hereinafter referred to as "connector longitudinal direction", a terminal part of the plate-shaped signal transmission medium (for example, FPC or FFC) F is assumed to be inserted from "connector front" toward "connector rear", and the inserting direction of the plate-shaped signal transmission medium F will be referred to as "medium inserting direction". Furthermore, the terminal part of the plate-shaped signal transmission medium F is assumed to be removed from the "connector rear" toward the "connector front", and the removing direction of the plate-shaped signal transmission medium F will be referred to as "medium removing direction". The electric connector 10 according to the present embodiment is used by being mounted on a surface of a printed wiring board, which is omitted in illustration; wherein the extending direction of the mounting surface of the printed wiring board is assumed to be "horizontal direction", the direction that gets away from the mounting surface of the printed wiring board is assumed to be "upward direction", and the direction that gets closer toward the mounting surface of the wiring board is assumed to be "downward direction".

Note that the electric connector 10 according to the present embodiment has a left-right symmetric structure in the "connector longitudinal direction", and the same constituent elements which are in left-right symmetric disposition relations are denoted by the same reference signs, and only the constituent elements of one side will be described.

In the above described insulating housing 11, as shown in FIG. 3, etc., a medium insertion path 11*a* having a slender hollow shape in which the plate-shaped signal transmission medium (for example, FPC or FFC) F is to be inserted is formed, and the surface of the insulating housing 11 which forms a lower wall surface (bottom wall surface) of the medium insertion path 11*a* is formed into a medium guide surface 11*b*, which contacts the plate-shaped signal transmission medium F and slidably guides the plate-shaped signal transmission medium F.

On the medium guide surface 11*b*, a plurality of contact housing portions 11*c*, 11*c*, and so on are provided in a recessed manner in a juxtaposed state at predetermined intervals along the "connector longitudinal direction". Each of the contact housing portions 11*c* is provided in a recessed manner so as to be in a state in which it is dented from the medium guide surface 11*b* like a groove, and the contact housing portion is extending in the "connector front-rear direction". In each of the contact housing portions 11*c*, part of an electrically-conductive contact member 13 serving as a contact member, which is formed by a thin-plate-shaped metal member of an appropriate shape, more specifically, a first main beam (lower beam) 13*c*1, which will be described later, is attached.

The above described plurality of electrically-conductive contact members 13 are arranged with appropriate intervals therebetween along the "connector longitudinal direction" so as to form a multipolar shape, and each of the electrically-conductive contact members 13 is configured to be used for signal transmission or for ground connection in a state in which it is mounted by solder joining with respect to an electrically-conductive path (electrode pattern) formed on the printed wiring board, which is omitted in illustration. The detailed structure of each of the electrically-conductive contact members 13 will be described later.

Figure 4:
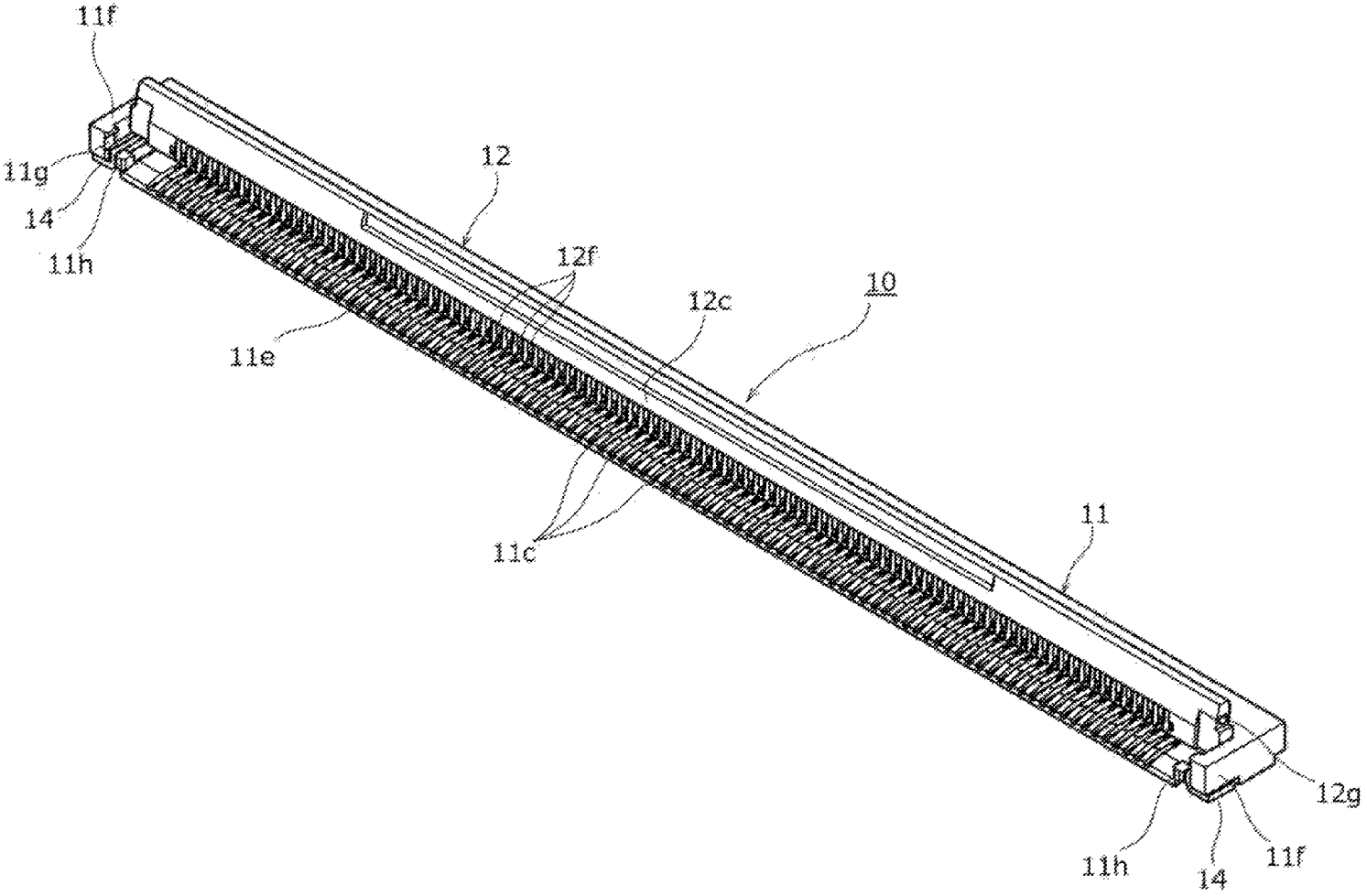
FIG. 4 is an external perspective explanatory view showing, from the front side, an overall configuration of a state in which the actuator of the electric connector shown in FIG. 1 to FIG. 3 is flipped up to a standby position (opened position)

The actuator 12 serving as the connection operating means is attached to the part of the insulating housing 11 that is close to the "connector front" side (the part close to the left side in FIG. 3 and FIG. 6) as described above. As shown in FIG. 4 and thereafter, the actuator 12 is configured to be subjected to a turning operation so as to be lifted up to the upper side. The front-end-side part (the part in the left side of FIG. 3 and FIG. 6) of the insulating housing 11 is configured to be in an open state (see FIG. 4 and FIG. 9) across almost the entire length of the "connector longitudinal direction".

The terminal part of the plate-shaped signal transmission medium F including, for example, the flexible printed circuit (FPC) or the flexible flat cable (FFC) is inserted into the medium insertion path 11*a* of the above described insulating housing 11 from the front-side part of the insulating housing 11, which has been brought into the open state in that manner; wherein, in the insertion of the plate-shaped signal transmission medium (for example, FPC or FFC) F, the movement is carried out when the plate-shaped signal transmission medium F slides toward the "connector rear" side along the medium guide surface 11*b*, which forms the lower wall surface (bottom wall surface) of the medium insertion path 11*a*. Similarly, in removal of the plate-shaped signal transmission medium F, movement is carried out in a state in which the plate-shaped signal transmission medium F slides toward the "connector front" side along the medium guide surface 11*b*.

Meanwhile, at a rear edge part (right edge part in FIG. 3 and FIG. 6) of the above described insulating housing 11, a plurality of part attachment openings 11*d*, 11*d*, and so on for attaching the electrically-conductive contact members 13, etc. to the interior of the insulating housing 11 are provided so as to be juxtaposed at constant intervals along the "connector longitudinal direction". These part attachment openings 11*d* respectively correspond to rear-end-side openings of the above described contact housing portions 11*c*, and the electrically-conductive contact members 13, which are to be inserted into the insulating housing 11 through the part attachment openings 11*d*, are inserted so as to slide toward the medium insertion path 11*a* including the contact housing portions 11*c* and are brought into a fixed state at the positions determined in advance.

On the other hand, the plurality of electrically-conductive contact members 13 are attached so as to form the multipolar arrangement shape in the "connector longitudinal direction" as described above, and the electrically-conductive contact members 13 are disposed respectively at the positions corresponding to the electrically-conductive paths (electrode pattern) of the plate-shaped signal transmission medium (for example, FPC or FFC) F inserted in the medium insertion path 11*a*. Although illustration of the electrically-conductive paths (electrode pattern) formed on the plate-shaped signal transmission medium F is omitted, they are electrically-conductive paths for signal transmission (signal-line pads) or electrically-conductive paths for shielding (shield-line pads) configured to be disposed at appropriate pitch intervals.

[About Contact Members]

Next, a specific structure of each of the electrically-conductive contact members 13 will be described. A fixation base portion 13*a* disposed in a rear end part of the electrically-conductive contact member 13 is configured to be in a fixed state so as to be sandwiched by inner wall surfaces of upper/lower wall portions, which form the part attachment opening 11*d* of the above described insulating housing 11. A board connecting portion 13*a*1 extending so as to form a step shape toward the "connector rear"-side outer side is continued from a lower end part of the fixation base portion 13*a*. The board connecting portion 13*a*1 is connected by solder joining with respect to the illustration-omitted electrically-conductive path (electrode pattern) on the printed wiring board, and the electric connector 1 is mounted by this solder joining.

Furthermore, an elastically-displaceable slender-bar-shaped coupling beam portion 13*b* is extending from an edge portion of the front side (left side in FIG. 3 and FIG. 6) of the fixation base portion 13*a* of each of the above described electrically-conductive contact members 13 toward the "connector front" side along the "horizontal direction", which is the extending direction of the printed wiring board (illustration omitted). Furthermore, a medium abutting portion 13*c* comparatively having rigidity and having an approximately U-shape in a lateral side is integrally continued from an extending-side end (left-side end in FIG. 3 and FIG. 6) of the coupling beam portion 13*b*, and the medium abutting portion 13*c* and the fixation base portion 13*a* are structured to be integrally connected to each other via the above described coupling beam portion 13*b*. As described later, the entire medium abutting portion 13*c* comparatively having rigidity is configured to be swing in a top-bottom direction as the coupling beam portion 13*b* is elastically displaced in the top-bottom direction.

Herein, the above described medium abutting portion 13*c* is provided with a first main beam (lower beam) 13*c*1 disposed at a lower part of the medium abutting portion 13*c* so as to extend approximately horizontally and a second main beam (upper beam) 13*c*2 disposed at an upper part so as to extend approximately horizontally, and the medium abutting portion 13*c* has a vertical sub-beam 13*c*3, which integrally couples end portions of the upper/lower first and second main beams 13*c*1 and 13*c*2 to each other. More specifically, the first main beam (lower beam) 13*c*1 is extending in the approximately horizontal direction like a cantilever from the lower end portion of the vertical sub-beam 13*c*3, the second main beam 13*c*2 is configured to extend in the approximately horizontal direction like a cantilever from the upper end portion of the vertical sub-beam 13*c*3, and the terminal part of the plate-shaped signal transmission medium (for example, FPC or FFC) F is configured to be inserted in the space which is formed by the vertical sub-beam 13*c*3 and the first and second main beams 13*c*1 and 13*c*2 and has an approximately U-shape in a lateral side.

Herein, when the actuator (connection operating means) 12 is subjected to a turning operation as described later, mainly, the coupling beam portion 13*b* having comparatively small rigidity is elastically displaced, and, along with that, particularly the first main beam 13*c*1 of the medium abutting portion 13*c* having comparatively large rigidity is configured to be displaced. The relation between the turning operation of the actuator 12 and the elastic displacement of the coupling beam portion 13*b* and the medium abutting portion 13*c* is a main configuration of the present invention and, therefore, will be described later in detail.

On the other hand, on an upper rim of a front end part of the above described first main beam 13*c*1, contact point portions 13*c*4 are provided so as to project to the upper side to correspond to the electrically-conductive paths (electrode pattern) of the plate-shaped signal transmission medium (for example, FPC or FFC) F. The contact point portions 13*c*4 are configured to abut a lower surface of the plate-shaped signal transmission medium F since the first main beam 13*c*1 constituting the medium abutting portion 13*c* is displaced, the plate-shaped signal transmission medium F is sandwiched between the medium abutting portion 13*c* and the actuator 12, and electric connection is established. This point will be also described later in detail.

Figure 1:
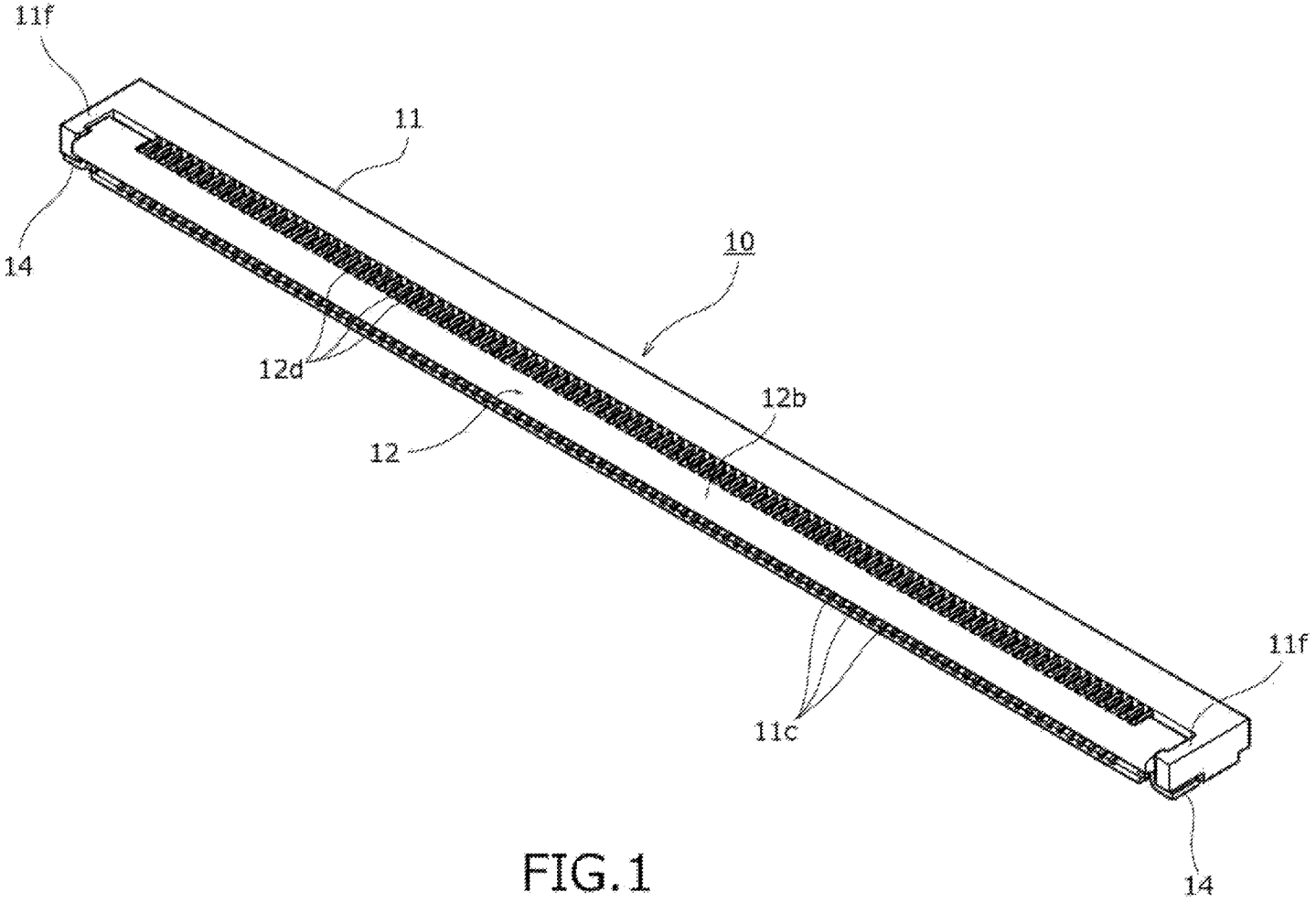
FIG. 1 is an external perspective explanatory view showing an electric connector according to an embodiment of the present invention and showing, from a front side, an overall configuration of a case in which an actuator is pushed down to a working position (closed position) in a state in which a plate-shaped signal transmission medium has not been inserted yet.

The actuator (connection operating means) 12 is configured to be subjected to a reciprocating operation between "standby position (opened position)" shown in FIG. 4 to FIG. 6 and "working position (closed position)" shown in FIG. 1 to FIG. 3. Based on the turning operation of the actuator 12, the coupling beam portion 13*b* is elastically deformed and displaces the medium abutting portion 13*c* as described later. However, in the state in which the actuator 12 is at the "standby position (opened position)", the elastic deformation of the above described coupling beam portion 13*b* is not carried out (see FIG. 10 and FIG. 12). As a result, the medium abutting portion 13*c* is also maintained in the state before the initial displacement, the first main beam (lower beam) 13*c*1 constituting part of the medium abutting portion 13*c* is maintained in the state in which it is disposed in the contact housing portion 11*c* of the insulating housing 11, and the contact point portions 13*c*4 of the first main beam 13*c*1 are also configured to be maintained in the "standby position" in which it is positioned in the contact housing portion 11*c* and is lowered below the medium insertion path 11*a*.

Figure 14:
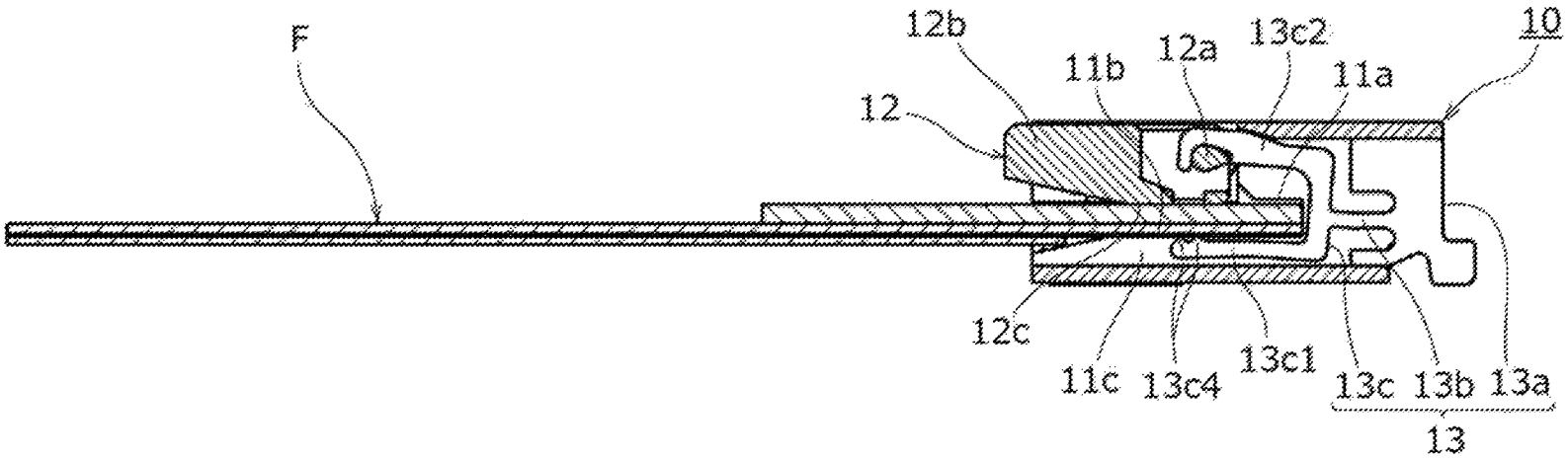
FIG. 14 is a transverse sectional explanatory view corresponding to FIG. 3 of the electric connector according to the present embodiment, which is in the state shown in FIG. 13.

On the other hand, particularly as shown in FIG. 14, when the actuator (connection operating means) 12 is turned to the "working position (opened position)" after the plate-shaped signal transmission medium (for example, FPC or FFC) F is inserted to the interior of the medium insertion path 11*a*, part of the actuator 12 abuts the plate-shaped signal transmission medium F as described later, as a result, mainly the coupling beam portion 13*b* is elastically displaced so as to be in an upward warped state, and the entire medium abutting portion 13*c* is displaced to the upper side based on the elastic displacement of the coupling beam portion 13*b*. As a result, the contact point portions 13c4 of the first main beam (lower beam) 13c1 constituting part of the medium abutting portion 13c become the "working state" in which they are disposed in the state in which they are displaced so as to project from the contact housing portion 11c to the upper side and moved toward the interior side of the medium insertion path 11a. Note that, when the contact point portions 13c4 of the first main beam (lower beam) 13c1 are to project from the contact housing portion 11c to the upper side, the contact point portions abut the plate-shaped signal transmission medium (for example, FPC or FFC) F; therefore, actually, the contact point portions remain in the interior of the contact housing portion 11c.

More specifically, when the entire medium abutting portion 13c, which forms part of the electrically-conductive contact member 13, is displaced to the upper side by the actuator 12, which has undergone the turning operation to the "working position (closed position)" as described above, the contact point portions 13c4 of the first main beam 13c1 are to project from the contact housing portion 11c to the upper side; however, the contact point portions 13c4 are in the disposition relation in which they face electrically-conductive paths (electrode pattern) of the plate-shaped signal transmission medium (for example, FPC or FFC) F, which is inserted to the interior of the insulating housing 11, from the lower side, and the contact point portions 13c4 are configured to be pushed against the electrically-conductive paths (electrode pattern) of the plate-shaped signal transmission medium F from the lower side. The configuration of the actuator 12 like this and the elastic displacement of the coupling beam portion 13b caused along the turning of the actuator 12 will be also described later in detail as a main part of the present invention.

[About Actuator]

Herein, the second main beam (upper beam) 13c2 is extending approximately horizontally from the upper end part of the vertical sub-beam 13c3 toward the connector front side as described above; wherein, the second main beam 13c2 is extending to an approximately central part in the connector front-rear direction in the state in which the second main beam 13c2 is close to an upper wall portion of the insulating housing 11, and the extending end part of the second main beam 13c2 is exposed to the upper side through a central opening 11e provided in the insulating housing 11.

More specifically, the above described central opening 11e of the insulating housing 11 is formed by cutting out the part of the upper wall surface portion of the insulating housing 11 that is from the connector front-rear-direction central part to the front side, and the central opening 11e is provided across approximately the entire length excluding lateral wall portions 11f, 11f provided at connector-longitudinal-direction both end portions. In the central opening 11e, the above described actuator (connection operating means) 12 is openably/closably disposed; in the region from the central opening 11e to the rear side, the second main beam 13c2 constituting part of the electrically-conductive contact member 13 is disposed as described above; and the front-end-side part of the second main beam 13c2 is in a disposition relation in which it is exposed to the upper side through the central opening 11e.

Meanwhile, in the front end parts of the lateral wall portions 11f, 11f of the insulating housing 11, for example as shown in FIG. 6, recession-shaped latched portions 11g are formed, and the actuator 12 is configured to be maintained in the state in which the actuator is horizontally pushed down like FIG. 1 to FIG. 3, FIG. 13, and FIG. 14 when later-described parts of the actuator (connection operating means) 12 are latched with the latched portions 11g.

Herein, in the front end part (left end part in FIG. 3 and FIG. 6) of the second main beam (upper beam) 13c2 constituting part of the above described electrically-conductive contact member 13, a shaft-bearing portion 13c5 is formed so as to form a recessed shape in a manner that it is opened toward the lower side. A turning shaft 12a serving as a shaft portion provided in the actuator (connection operating means) 12 is disposed so as to slidably contact the shaft-bearing portion 13c5, which is provided at the second main beam 13c2, from the lower side, and the actuator 12 is configured to be turned about the turning shaft (shaft portion) 12a.

The actuator (connection operating means) 12, which is subjected to a turning operation about the turning shaft (shaft portion) 12a in this manner, has an operation main-body portion 12b formed by a plate-shaped member extending in the connector longitudinal direction. The plate-shaped member constituting the operation main-body portion 12b is provided with a pair of edge portions (left/right edge portions of the actuator 12 of FIG. 3), and the above described turning shaft 12a is extending so as to be along one of the edge portions.

The longitudinal-direction both-side shaft end parts of the turning shaft (shaft portion) 12a are formed into shaft-end supporting portions (illustration omitted), which are projecting from the connector-longitudinal-direction both end surfaces of the operation main-body portion 12b toward the outer side. Both of the shaft-end supporting portions are slidably supported from the lower side by upper rim portions of metal retainer fittings 14 disposed along the inner surface sides of the lateral wall portions 11f, 11f of the insulating housing 11, and, as a result, the turning shaft 12a is supported so as not to fall to the lower side from the shaft-bearing portions 13c of the electrically-conductive contact members 13. The turn operating force of an operator is configured to be applied to the outer part of the turning radius about the turning shaft (shaft portion) 12a like this.

Note that the lower edge parts of the above described metal retainer fittings 14 are configured to be placed on the illustration-omitted printed wiring board and mounted (fixed) by solder joining.

Furthermore, on the "connector-longitudinal-direction" both-side lateral wall surfaces of the operation main-body portion 12b of the actuator (connection operating means) 12, latching portions 12g, which are formed so as to form projecting shapes toward the outer side in the "connector longitudinal direction", are respectively provided (see FIG. 4). The latching portions 12g provided on the actuator 12 are configured to be mated with the latched portions 11g of the insulating housing 11 side when the actuator 12 is turned so as to be horizontally pushed down. When both of the members 12g, 11g are mated with each other, the actuator 12 is maintained in the horizontally pushed-down state (see FIG. 1 to FIG. 3, FIG. 13, and FIG. 14).

More specifically, the actuator (connection operating means) 12 is disposed so as to close the above described central opening 11e of the insulating housing 11 in the state in which the actuator is horizontally pushed down (see FIG. 1 to FIG. 3, FIG. 13, and FIG. 14), and an opening and turning operation of the actuator 12 is configured to be carried out from the "working position (closed position)" at which the actuator is horizontally pushed down by a closing and turning operation of the actuator 12 like this to the "standby position (opened position)" at which the actuator is lifted up to the upper aide as shown in FIG. 4 to FIG. 6 and FIG. 9 to FIG. 12. The actuator 12 which has undergone the opening and turning operation to the "standby position (opened position)" abuts part of the insulating housing 11 and stops turning in an upright state or in a state in which the actuator is somewhat pushed down to the rear side.

When the opening and turning operation is carried out in this manner so that the actuator (connection operating means) 12 is lifted up to the "standby position (opened position)" (see FIG. 4 to FIG. 6 and FIG. 9 to FIG. 12), the central opening 11*e* of the insulating housing 11 is caused to be in an upward opened state, and the terminal part of the plate-shaped signal transmission medium (for example, FPC or FFC) F is placed from the upper side onto the medium guide surface 11*b* via the central opening 11*e* of the insulating housing 11, which has been caused to be in the opened state.

The terminal part of the plate-shaped signal transmission medium (for example, FPC or FFC) F, which is placed from the central opening 11*e* of the insulating housing 11, is inserted from the connector front side toward the rear side and stops in the state in which it is abutting the wall portion of the insulating housing 11. At this point, the contact point portions 13*c*4 of the electrically-conductive contact member 13 are positioned in the interior of the contact housing portions 11*c* and are maintained in the state in which the contact point portions are lowered below the medium guide surface 11*b*. Therefore, the contact point portions 13*c*4 of the electrically-conductive contact members 13 in this case do not contact the plate-shaped signal transmission medium F, and unnecessary conduction or damage can be prevented from occurring. Note that, although these are not employed in the present embodiment, if positioning latch plates are provided at both-side edge portions of the terminal part of the plate-shaped signal transmission medium F so as to bulge to the both outer sides so that they abut lock plates 11*h*, 11*h*, which are disposed at the longitudinal-direction both-side parts of the insulating housing 11 so as to be opposed to each other, the movement of the plate-shaped signal transmission medium F in the extending direction can be regulated, and positioning of the plate-shaped signal transmission medium F can be carried out by that.

Figure 13:
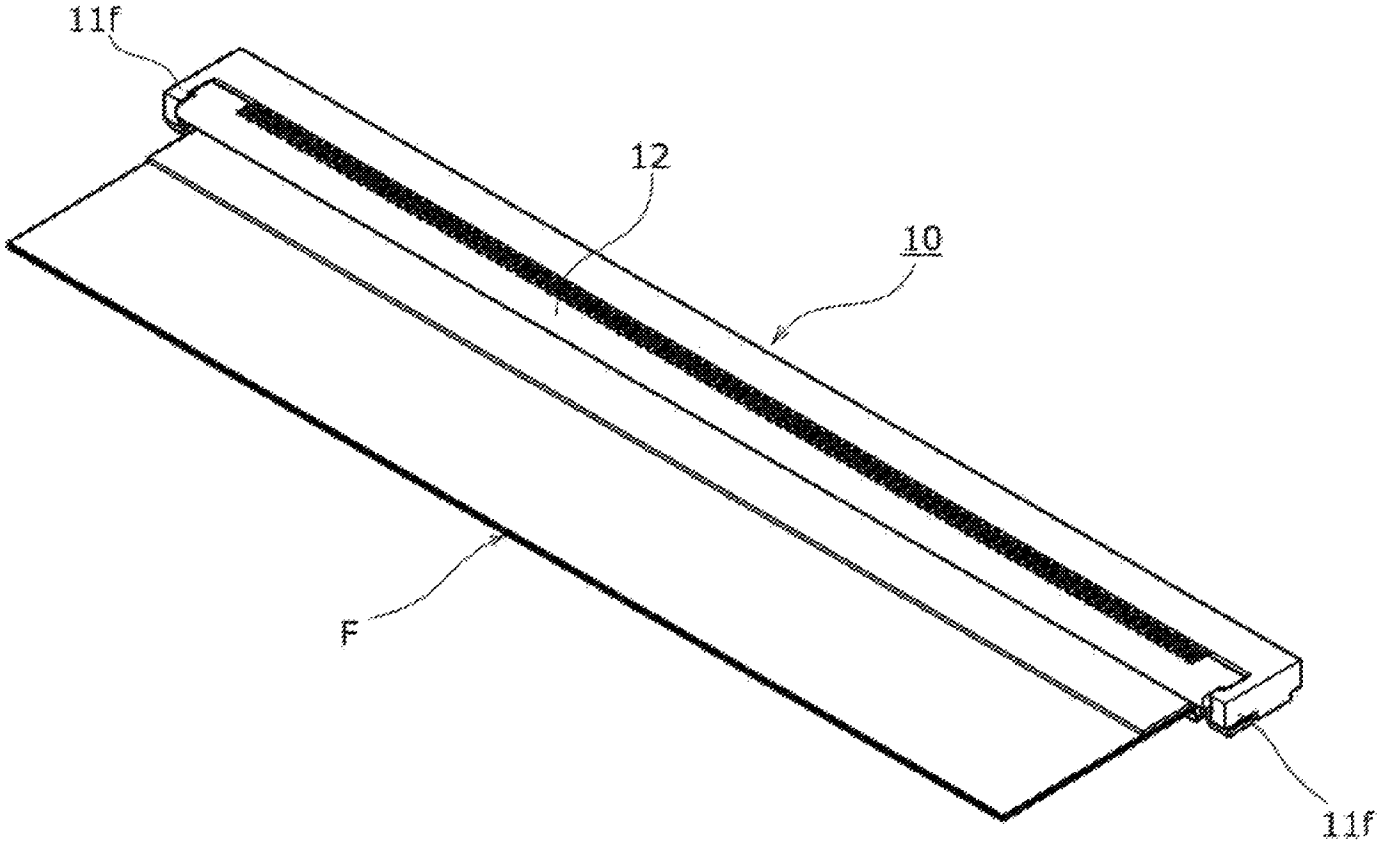
FIG. 13 is an external perspective explanatory view showing, from the front side, a state in which the actuator is turned to the "working position" from the state shown in FIG. 11.

Next, the closing and turning operation is carried out so that the actuator (connection operating means) 12, which has been at the "standby position (opened position)", is pushed down to the connector front side and moved (turned) to the "working position (closed position)" as shown in FIG. 13 and FIG. 14, the latching portions 12*g*, which are provided on the operation main-body portion 12*b* so as to form the projecting shapes as described above, are latched with the latched portions 11*g* of the insulating housing 11 and maintained at the "working position (closed position)".

As described later, medium pressing portions 12*c* are formed on the surface corresponding to the lower surface of the actuator (connection operating means) 12 moved (turned) to the "working position (closed position)". The medium pressing portions 12*c* press the upper surface (one of the surfaces) of the plate-shaped signal transmission medium (for example, FPC or FFC) F toward the lower side, and, at the same time, the above described coupling beam portion 13*b* of the electrically-conductive contact member 13 is elastically deformed; as a result, the entire medium abutting portion 13*c* is displaced to the upper side. The contact point portions 13*c*4 of the first main beam (lower beam) 13*c*1 constituting part of the medium abutting portion 13*c* are configured to be displaced to the upper side and pushed against the electrically-conductive paths (electrode pattern) of the plate-shaped signal transmission medium F, which is placed on the medium guide surface 11*b*, from the lower side to the upper side as a result.

On the other hand, for example as shown in FIG. 6, on the operation main-body portion 12*b* of the actuator (connection operating means) 12, a plurality of shaft-bearing housing portions 12*d*, which house the above described shaft-bearing parts of the second main beams (upper beams) 13*c*2 serving as part of the electrically-conductive contact members 13, are provided in a recessed manner so as to form comb-teeth shapes. Each of the shaft-bearing housing portions 12*d* is disposed at the same position as the above described electrically-conductive contact member 13 in the connector longitudinal direction (the direction of the multipolar arrangement), and the shaft-bearing portion 13*c*5 of the second main beam 13*c*2 is disposed so as to be inserted in the shaft-bearing housing portion 12*d* of the actuator 12. As described above, the turning shaft 12*a* of the actuator 12 is disposed so as to contact and be pushed against the shaft-bearing portion 13*c*5 of the second main beam 13*c*2 from the lower side, the turning shaft 12*a* of the actuator 12 is disposed in a slidable state with respect to a turning-shaft bearing surface formed so as to form a curved shape on the inner peripheral surface of the shaft-bearing portion 13*c*5, and, as a result, the turning shaft is configured to be turnably retained.

Meanwhile, as described above, on the operation main-body portion 12*b* of the actuator (connection operating means) 12, the medium pressing portions 12*c*, which press the upper surface (one of the surfaces) of the plate-shaped signal transmission medium (for example, FPC or FFC) F are formed at the positions corresponding to the electrically-conductive contact members 13. The medium pressing portions 12*c* are formed on the surface corresponding to the lower surface of the actuator 12 which has been moved (turned) to the "working position (closed position)" and are formed by linear projecting portions disposed at predetermined pitch intervals in the connector longitudinal direction, which is the multipolar arrangement direction of the electrically-conductive contact members 13. The linear projecting portions forming the medium pressing portions 12*c* are slenderly extending along the turning-radius direction of the actuator 12 and are formed so that the transverse cross-sectional shapes thereof along the multipolar arrangement direction (connector longitudinal direction) form approximately rectangular shapes.

On the other hand, in each part between a pair of the medium pressing portions 12*c*, 12*c*, which are provided so as to be adjacent to each other in the multipolar arrangement direction (connector longitudinal direction), a groove portion similarly slenderly extending along the turning-radius direction of the actuator (connection operating means) 12 is provided in a recessed manner. These groove portions are formed no that the transverse cross-sectional shapes thereof along the multipolar arrangement direction (connector longitudinal direction) form approximately rectangular shapes so that the actuator 12 becomes a non-contact state with respect to the upper surface (one of the surfaces) of the plate-shaped signal transmission medium (for example, FPC or FFC) F and does not carry out the pressing action with respect to the plate-shaped signal transmission medium F even in the state in which the actuator is turned to the "working position (closed position)".

In this manner, the medium pressing portions 12*c* provided in the actuator (connection operating means) 12 are disposed at the same positions as the electrically-conductive contact members 13 in the multipolar arrangement direction (connector longitudinal direction) of the electrically-conductive contact members 13. Therefore, when the actuator disposed at the "standby position (opened position)" in a manner that it is flipped up to the upper side is subjected to the turning operation so as to be pushed down approximately horizontally toward the connector front side and is turned to the "working position (closed position)", the medium pressing portions 12*c* of the actuator 12 are in a disposition relation in which they face the electrically-conductive contact members 13 from immediately above.

More specifically, when the actuator (connection operating means) 12 in the state in which the terminal part of the plate-shaped signal transmission medium (for example, FPC or FFC) F is inserted in the insulating housing 11 (see FIG. 11 and FIG. 12) is subjected to the closing and turning operation to the "working position (closed position)" (see FIG. 13 and FIG. 14), the medium pressing portions 12*c* of the actuator 12 formed by the slender linear projecting portions as described above press the upper surface (one of the surfaces) of the plate-shaped signal transmission medium F toward the lower side. As a result, the electrically-conductive paths (electrode pattern) provided on the lower surface (the other surface) of the plate-shaped signal transmission medium F become a pressure-contact state and are pushed against the contact point portions 13*c*4 of the electrically-conductive contact members 13.

On the other hand, the groove portion provided in the part between the pair of medium pressing portions 12*c*, 12*c*, which are adjacent to each other in the multipolar arrangement direction (connector longitudinal direction) is maintained in the non-contact state with respect to the surface of the plate-shaped signal transmission medium (for example, FPC or FFC) F even if the actuator (connection operating means) 12 is turned to the "working position (closed position)". By virtue of having the groove portions like this, elastically deformable parts of the plate-shaped signal transmission medium F are housed in the spaces of the groove portions, the electrically-conductive paths (electrode pattern) provided on the plate-shaped signal transmission medium F are reliably brought into contact with the contact point portions 13*c*4 of the first main beams 13*c*1, and the retaining force with respect to the plate-shaped signal transmission medium F is also improved.

Furthermore, for example as shown in FIG. 6, in part of the medium pressing portion 12*c* provided in the actuator (connection operating means) 12, a deformation allowing portion 12*f* is provided so as to communicate from the outer surface of the medium pressing portion 12*c* to the above described shaft-bearing housing portion 12*d*. The deformation allowing portion 12*f* is formed by a through hole formed from the position immediately above the contact point portion 13*c*4 of the electrically-conductive contact member 13 to a position in a somewhat rear side in the state in which the actuator (connection operating means) 12 is turned to the "working position (closed position)", and the elastically deformable part of the plate-shaped signal transmission medium F in the case in which the medium pressing portion 12*c* of the actuator 12 presses the plate-shaped signal transmission medium (for example, FPC or FFC) F in the above described manner is configured to be housed in the inner space of the above described deformation allowing portion 12*f*.

Herein, in the above described operation main-body portion 12*b* of the actuator (connection operating means) 12, an actuator cam 12*h*, which elastically displaces the electrically-conductive contact member 13 until the plate-shaped signal transmission medium (for example, FPC or FFC) F is finally fixed and creates a clicking sensation of the turning operation, is provided. The actuator cam 12*h* is formed to have a cam surface, which forms an edge portion extending in the top-bottom direction of the deformation allowing portion 12*f* of the above described medium pressing portion (linear projecting portion) 12*c* in the state in which the actuator 12 is raised to the "standby position (opened position)" (see FIG. 4 to FIG. 6 and FIG. 9 to FIG. 12). The cam surface of the actuator cam 12*h* is disposed in the connector front side of the above described turning shaft 12*a*, and a distal end portion of the cam surface (lower end portion in FIG. 6) has a shape projecting somewhat toward the lower side compared with the turning shaft 12*a*.

More specifically, the cam surface of the actuator cam 12*h* is provided so as to bulge toward the outer side in the direction of the turning radius about the turning shaft 12*a* as described above; wherein, the contact point portions 13*c*4 provided in the first main beam (lower beam) 13*c*1 of the above described electrically-conductive contact member 13 are disposed so as to be opposed to the actuator cam 12*h* from the lower side. More specifically, as shown by a reference sign A in FIG. 3, the contact point portions 13*c*4 of the first main beam 13*c*1 are disposed to be opposed to the part between an end surface (right-side end surface in FIG. 3) of the actuator cam 12*h* in the state in which it is turned to the "working position (closed position)" and the turning-shaft bearing surface (left end surface of the shaft-bearing portion 13*c*5 in FIG. 3) of the shaft-bearing portion 13*c*5 provided in the above described second main beam 13*c*2. As a result of employing such a configuration, the contact point portions 13*c*4 of the electrically-conductive contact member 13 stably contact the plate-shaped signal transmission medium (for example, FPC or FFC) F.

Herein, the cam surface of the above described actuator cam 12*h* is disposed in the front side of the medium pressing portion 12*c* in the direction of the circumferential trajectory of the closing and turning operation in which the actuator (connection operating means) 12 which has been at the "standby position (opened position)" is pushed down toward the "working position (closed position)", the distance (radius) from the turning shaft 12*a* serving as a turning center of the actuator 12 to the cam surface is set to be somewhat larger than the distance (radius) which is similarly from the turning shaft 12*a* to the medium pressing portion 12*c*, and "cam action" based on the difference between the radius lengths in the turning of the actuator cam 12*h* is configured to be carried out.

More specifically, when the actuator (connection operating means) 12 is subjected to the turning operation in the closing direction in the state in which the plate-shaped signal transmission medium (for example, FPC or FFC) F is inserted in the medium insertion path 11*a*, an apex portion of the cam surface of the actuator cam 12*h* is brought into pressure-contact with the surface of the plate-shaped signal transmission medium F at the timing immediately before the above described medium pressing portion 12*c* is pushed against the surface of the plate-shaped signal transmission medium F. Then, the front-side part of the electrically-conductive contact member 13 is displaced so as to be lifted to the upper side by the reaction which is caused when the medium pressing portion 12*c* is brought into the pressure contact. When the front-side part of the electrically-conductive contact member 13 is displaced to the upper side in such a manner, bending stress in an upward warping direction is generated with respect to the medium abutting portion 13*c* of the electrically-conductive contact member 13 and the coupling beam portion 13*b*, which couples the medium abutting portion 13*c* to the fixation base portion 13*a*, and, in the present embodiment, the rigidity relation between the medium abutting portion 13*c* and the coupling beam portion 13*b* is set in a following manner.

Specifically, in the case in which the electrically-conductive contact member 13 is elastically displaced to the upper side in the above described manner, first, the fixation base portion 13*a* solder-joined on the printed wiring board (illustration omitted) is in a fixed state and therefore does not cause displacement; therefore, the relation of the displacement of the medium abutting portion 13*c* and the coupling beam portion 13*b* is only required to be considered. In the present embodiment, a rigidity F1 of the coupling beam portion 13*b* is set to be comparatively small, and a rigidity F2 of the medium abutting portion 13*c* is set to be comparatively large. More specifically, the rigidity F1 of the coupling beam portion 13*b* of the case in which the coupling beam portion 13*b* is elastically displaced is set to be the same or smaller than the rigidity F2 of the medium abutting portion 13*c* of the case in which the medium abutting portion 13*c* is displaced in the direction to abut the plate-shaped signal transmission medium (for example, FPC or FFC) F ($F1 \leq F2$).

Therefore, when elastic displacement is carried out so that the electrically-conductive contact member 13 is lifted up to the upper side by the above described "cam action" based on the turning of the actuator cam 12*h*, the medium abutting portion 13*c* having the comparatively high rigidity maintains approximately the original shape, while the coupling beam portion 13*b* having the comparatively low rigidity is elastically displaced in an upward warped state, and, as a result, the medium abutting portion 13*c* is displaced so as to be lifted up to the upper side while a root part of the coupling beam portion 13*b* or a vicinity thereof serves as the center thereof. Specifically, while the actuator (connection operating means) 12 is at the "standby position (opened position)", the contact point portions 13*c*4 of the first main beam 13*c*1 constituting the medium abutting portion 13*c* are positioned in the interior of the contact housing portion 11*c* and are lowered below the medium insertion path 11*a*.

On the other hand, the contact point portions 13*c*4 of the first main beam 13*c*1 are configured to project from the interior of the contact housing portion 11*c* to the outer side (upper side) of the medium guide surface 11*b* and are displaced to the state in which they are disposed in the interior of the medium insertion path 11*a* when the actuator (connection operating means) 12 have undergone the turning operation to the "working position (closed position)". Then, the contact point portions 13*c*4 of the first main beam 13*c*1 disposed in the interior of the medium insertion path 11*a* are pushed against the electrically-conductive paths (electrode pattern) of the plate-shaped signal transmission medium F from the lower side.

Note that, since the contact point portions 13*c*4 of the first main beam (lower beam) 13*c*1 abut the lower surface of the plate-shaped signal transmission medium (for example, FPC or FFC) F when the contact point portions are to project from the contact housing portion 11*c* to the upper side, in practice, the contact point portions remain in the interior of the contact housing portion 11*c*. Meanwhile, for example if the actuator 12 is subjected to the turning operation in the closing direction by an erroneous operation in the state in which the plate-shaped signal transmission medium F is not inserted in the interior of the medium insertion path 11*a* as shown in FIG. 3, no elastic deformation or displacement is caused since the actuator cam 12*h* is not brought into pressure-contact with the surface of the plate-shaped signal transmission medium F.

Meanwhile, in the process in which the actuator (connection operating means) 12 is subjected to the turning operation in the closing direction from the standby position, after the actuator cam 12*h* is detached from the surface of the plate-shaped signal transmission medium F, the medium pressing portion 12*c* is brought into pressure-contact with the surface of the plate-shaped signal transmission medium F, and so-called clicking sensation and clicking sound in the closing and turning operation are configured to be obtained.

As described above, according to the electric connector 10 according to the present embodiment, in the stage in which the actuator cam 12*h* of the actuator (connection operating means) 12 is at the "standby position (opened position)" before the abutting with the plate-shaped signal transmission medium (for example, FPC or FFC) F is carried out, the contact point portions 13*c*4 of the electrically-conductive contact member 13 are positioned in the interior of the contact housing portion 11*c* and are maintained in the state in which the contact point portions are lowered below the medium guide surface 11*b*. Therefore, the contact point portions 13*c*4 of the electrically-conductive contact member 13 in this case do not contact the plate-shaped signal transmission medium F, and unnecessary conduction or damage of the plate-shaped signal transmission medium F are prevented from occurring.

Moreover, according to the configuration of the present embodiment, when the actuator (connection operating means) 12 is turned to the "working position (closed position)", the actuator cam 12*h* of the actuator 12 presses the plate-shaped signal transmission medium (for example, FPC or FFC) F at the position opposed to, in the top-bottom direction, the contact point portions 13*c*4 of the electrically-conductive contact member 13; therefore, the contact pressure applied from the actuator cam 12*h* to the plate-shaped signal transmission medium F is reliably applied to the contact point portions 13*c*4 of the electrically-conductive contact member 13 without being dispersed.

Figure 15:
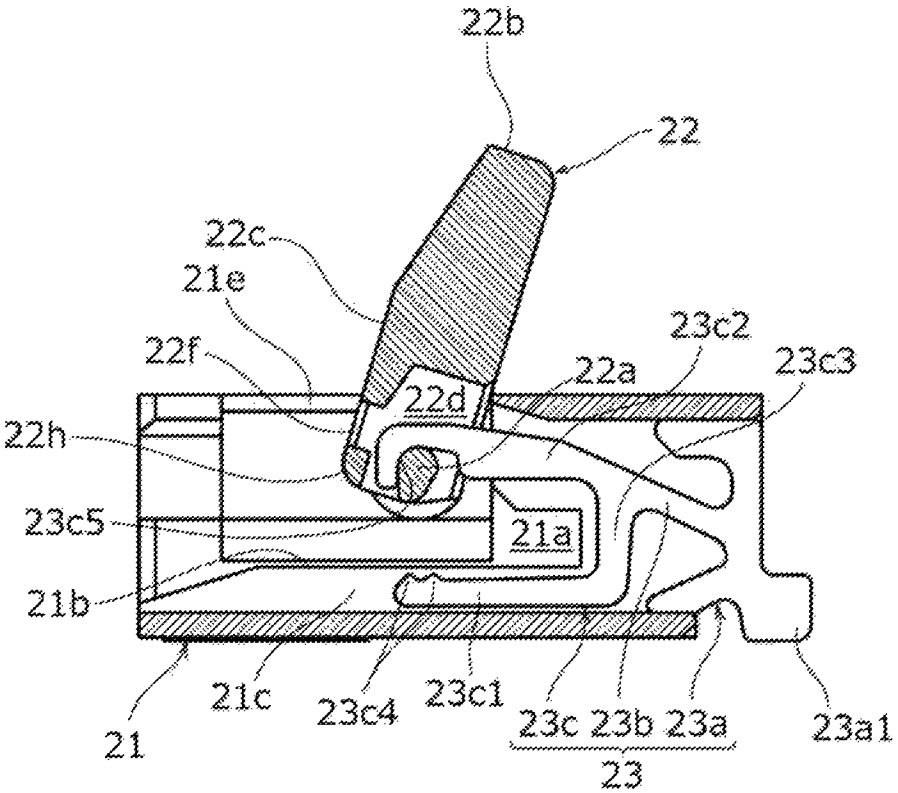
FIG. 15 is a cross-sectional explanatory view corresponding to FIG. 6 and showing an electric connector according to another embodiment of the present invention.
Figure 16:
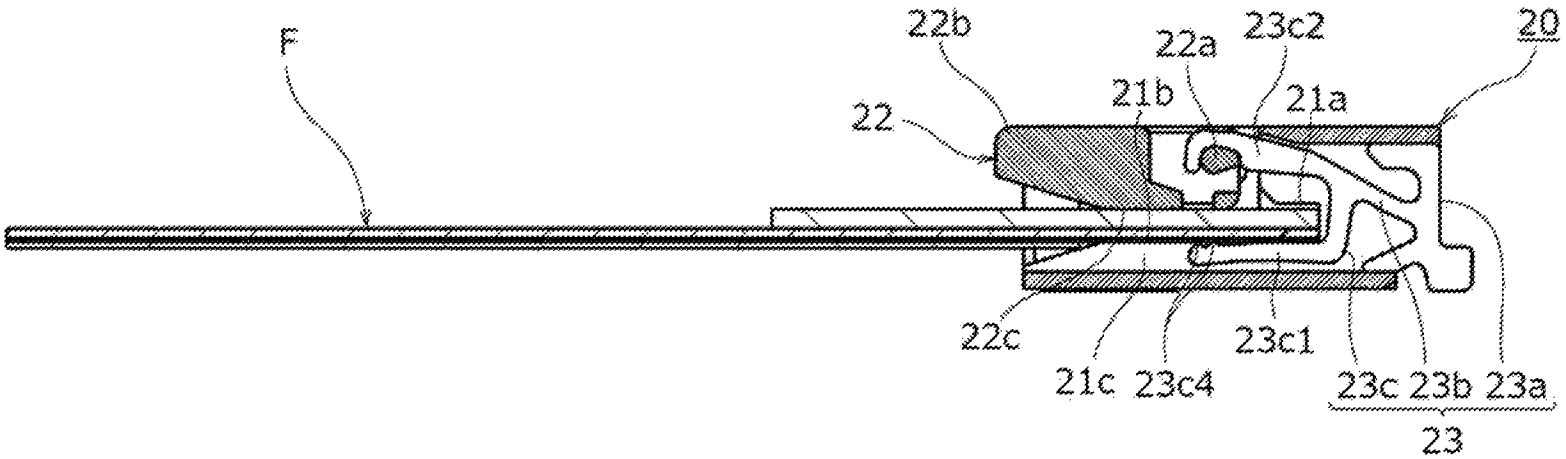
FIG. 16 is a cross-sectional explanatory view showing a state in which the actuator is turned to the "working position" after the plate-shaped signal transmission medium is inserted from the state shown in FIG. 15.

On the other hand, in another embodiment according to FIG. 15 and FIG. 16 in which the members corresponding to the members of the above described embodiment are shown by changing the tens place thereof to "2", a coupling beam portion 23*b* connecting a medium abutting portion 23*c* of an electrically-conductive contact member 23 to a fixation base portion 23*a* is disposed in a state in which it is tilted with respect to the extending direction (horizontal direction) of a printed wiring board (illustration omitted). More specifically, the coupling beam portion 23*b* in the present embodiment is configured to be extended to the obliquely upper side from the fixation base portion 23*a* toward the medium abutting portion 23*c*.

Furthermore, the coupling beam portion 23*b* in the present embodiment is extending so as to be continued to a rear end part of a second main beam (upper beam) 23*c*2, which forms part of the medium abutting portion 23*c*, and the coupling beam portion 23*b* is configured to form part of the second main beam (upper beam) 23*c*2.

The configuration according to this different embodiment like this also exerts working/effects similar to those of the above described embodiment. However, since the coupling beam portion 23*b* is tilted and extended particularly in the present embodiment, the span length of the coupling beam portion 23*c* is sufficiently ensured in small space, and the plate-shaped signal transmission medium F is stably sandwiched. Moreover, since the coupling beam portion 23*b* is configured to form part of the second main beam (upper beam) 23*c*2, the stress generated in the coupling beam portion 23*b* is dispersed toward the second main beam 23*c*2, and plastic deformation or damage caused by stress concentration are prevented. Note that even if the coupling beam portion 23*b* is configured to form part of a first main beam (lower beam) 23*c*1, similar working of stress dispersion is obtained.

Hereinabove, the invention accomplished by the present inventors has been described in detail based on the embodiments. However, the present invention is not limited to the above described embodiments, and it goes without saying that various modifications can be made within the range not departing from the gist thereof.

For example, in the above described embodiments, the flexible printed circuit (FPC) and the flexible flat cable (FFC) are employed as the plate-shaped signal transmission medium to be fixed to the electric connector. However, the present invention can be similarly applied also to the cases in which other signal-transmitting media, etc. are used.

Moreover, the actuators according to the above described embodiments are configured to be turned toward the connector front side. However, the present invention can be similarly applied also to electric connectors configured to carry out the turning toward the connector rear side.

Furthermore, the electric connectors according to the above described embodiments employ the configuration in which the electrically-conductive contact members having the same shape are arranged in multipolar shape. However, the present invention can be similarly applied also to the cases in which electrically-conductive contact members having different shapes are used.

Furthermore, the present invention can be applied not only to a horizontal-insertion-type electric connector like the above described embodiments, in other words, an electric connector of a type in which a signal transmission medium is inserted approximately in parallel with respect to a wiring board, but also to an electric connector of a perpendicular-insertion-type in which a signal transmission medium is inserted approximately perpendicularly with respect to a wiring board.

The present invention can be widely applied to a wide variety of electric connectors used in various electric devices.

What is claimed is:

1. An electric connector used in a state in which the electric connector is mounted on a wiring board, the electric connector comprising:

an insulating housing having a medium insertion path to which a plate-shaped signal transmission medium is to be inserted;

a medium guide surface serving as part of a surface of the insulating housing forming the medium insertion path and configured to guide the plate-shaped signal transmission medium inserted to interior of the medium insertion path;

a contact housing portion provided in a recessed manner in a state in which the contact housing portion is dented in a groove shape from the medium guide surface;

an electrically-conducive contact member having part disposed in interior of the contact housing portion; and an actuator cam turnably attached to the insulating housing and configured to be subjected to a turning operation about a turning shaft determined in advance so as to reciprocate between a standby position and a working position;

the electric connector configured so that a contact point portion of the contact member abuts the plate-shaped signal transmission medium inserted in the medium insertion path along the medium guide surface when the contact member is elastically displaced by the actuator cam undergone the turning operation from the standby position to the working position, wherein the contact member is provided with a medium abutting portion having first and second main beams configured to be displaced by the actuator cam, a fixation base portion connected to the wiring board, and an elastically-displaceable coupling beam portion integrally connecting the medium abutting portion and the fixation base portion;

a rigidity F1 of the coupling beam portion of a case in which the coupling beam portion is elastically displaced is set to be the same as or smaller than a rigidity F2 of the medium abutting portion of a case of displacement to a direction in which the medium abutting portion abuts the plate-shaped signal transmission medium ($F1 \leq F2$);

while, when the actuator cam is at the standby position, the contact point portion of the first or second main beam constituting the contact member is positioned in the interior of the contact housing portion and maintained in a state in which the contact point portion is lowered below the medium guide surface from the medium insertion path; and the contact point portion the first or second main beam in a case in which the actuator cam is subjected to the turning operation toward the working position is displaced from the interior of the contact housing portion toward the medium guide surface and abuts the plate-shaped signal transmission medium disposed in the medium insertion path.

2. The electric connector according to claim 1, wherein the actuator cam is turnably supported by a turning-shaft bearing surface provided on the contact member;

the contact point portion of the contact member is disposed to be opposed to the actuator cam; and the contact point portion of the contact member is disposed to be opposed to a part between an end surface of the actuator cam in the state turned to the working position and the turning-shaft bearing surface.

3. The electric connector according to claim 1, wherein the coupling beam portion of the contact member is disposed to be tilted with respect to an extending direction of the wiring board.

4. The electric connector according to claim 3, wherein the coupling beam portion of the contact member constitutes part of the first or second main beam.

* * * * *